US009884367B2

(12) United States Patent
Yamazaki et al.

(10) Patent No.: US 9,884,367 B2
(45) Date of Patent: Feb. 6, 2018

(54) MO—SI—B-BASED ALLOY POWDER, METAL-MATERIAL RAW MATERIAL POWDER, AND METHOD OF MANUFACTURING A MO—SI—B-BASED ALLOY POWDER

(71) Applicant: A.L.M.T. Corp., Minato-ku, Tokyo (JP)

(72) Inventors: Shigekazu Yamazaki, Toyama (JP); Ayuri Tsuji, Toyama (JP); Masahiro Katoh, Toyama (JP); Seiji Nakabayashi, Toyama (JP); Akihiko Ikegaya, Toyama (JP)

(73) Assignee: A.L.M.T. Corp., Tokyo (JP)

( * ) Notice: Subject to any disclaimer, the term of this patent is extended or adjusted under 35 U.S.C. 154(b) by 819 days.

(21) Appl. No.: 14/368,976

(22) PCT Filed: Dec. 21, 2012

(86) PCT No.: PCT/JP2012/083218

§ 371 (c)(1),
(2) Date: Jun. 26, 2014

(87) PCT Pub. No.: WO2013/099791

PCT Pub. Date: Jul. 4, 2013

(65) Prior Publication Data

US 2014/0373681 A1 Dec. 25, 2014

(30) Foreign Application Priority Data

Dec. 28, 2011 (JP) ..... 2011-288321

(51) Int. Cl.
*B22F 1/00* (2006.01)
*C22C 27/04* (2006.01)
(Continued)

(52) U.S. Cl.
CPC ..... *B22F 1/0003* (2013.01); *B22F 9/04* (2013.01); *C22C 1/045* (2013.01); *C22C 27/04* (2013.01);
(Continued)

(58) Field of Classification Search
None
See application file for complete search history.

(56) References Cited

U.S. PATENT DOCUMENTS 5,593,156 A 1/1997 Jambor
5,595,616 A 1/1997 Berczik
(Continued)

FOREIGN PATENT DOCUMENTS

EP 2208558 A1 7/2010
JP 2004-115833 A 4/2004
(Continued)

OTHER PUBLICATIONS

Communication dated Jun. 21, 2016 from the European Patent Office in counterpart application No. 12863978.8.
(Continued)

*Primary Examiner* — Jessee Roe
*Assistant Examiner* — Ngoclan T Mai
(74) *Attorney, Agent, or Firm* — Sughrue Mion, PLLC

(57) ABSTRACT

A Mo—Si—B-based alloy for a heat-resistant alloy that satisfies, more than conventional, physical properties such as proof stress and hardness adapted to an increase in the melting point of 5 a welding object. The Mo—Si—B-based alloy powder is such that the full width at half maximum of (600) of Mo5SiB2 in X-ray diffraction peak data is 0.08 degrees or more and 0.7 degrees or less.

10 Claims, 4 Drawing Sheets

(51) Int. Cl.
*C22C 1/04* (2006.01)
*B22F 9/04* (2006.01)

(52) U.S. Cl.
CPC ..... *B22F 2009/041* (2013.01); *B22F 2301/20* (2013.01); *B22F 2998/10* (2013.01)

(56) References Cited

U.S. PATENT DOCUMENTS

| | | | | |
|---|---|---|---|---|
| 7,767,138 | B2 | 8/2010 | Jehanno et al. | |
| 7,806,995 | B2 * | 10/2010 | Jehanno | C22C 27/04 148/423 |
| 2006/0169369 | A1 | 8/2006 | Jehanno | |
| 2006/0285990 | A1 | 12/2006 | Jehanno et al. | |
| 2008/0128472 | A1 | 6/2008 | Park et al. | |
| 2009/0011266 | A1 * | 1/2009 | Cochran | C22C 1/0491 428/545 |
| 2010/0154590 | A1 * | 6/2010 | Myers | B22F 1/0096 75/255 |

FOREIGN PATENT DOCUMENTS

| | | | |
|---|---|---|---|
| JP | 2005-314715 | A | 11/2005 |
| JP | 2008-114258 | A | 5/2008 |
| JP | 2008-246553 | A | 10/2008 |

OTHER PUBLICATIONS

Nakamura et al., "Site-occupation behavior and solid-solution hardening effect of rhenium in $Mo_5SiB_2$," Intermetallics, vol. 53 (2014) pp. 85-91.

Aronsson, "The Crystal Structure of $Mo_5SiB_2$," ACTA Chemica Scandinavica, vol. 12 (1958) pp. 31-37.

Hawthorne,"Quantitative characterization of site-occupancies in minerals," American Mineralogist, vol. 68 (1983) pp. 287-306.

Muzzy et al., "Structure and superconductivity in Zr-stabilized, nonstoichiometric molybdenum diboride," Physica C, vol. 382 (2002) pp. 153-165.

Rawn C et al: "The crystal structure and thermal expansion of Mo5SiB2", Intermetallics, Elsevier Science Publishers B.V, GB, (2001) pp. 209-216, XP027383223, ISSN: 0966-9795.

Garlea V O et al: "The high-resolution powder diffractometer at the high flux isotope reactor", Applied Physics A; Materials Science & Processing, Springer, Berlin, DE, Mar. 16, 2010 (Mar. 16, 2010), pp. 531-535, XP019844545, ISSN: 1432-0630.

Communication dated Aug. 28, 2015 from the European Patent Office issued in corresponding application No. 12863978.8.

Kazuhiro Ito et al., "Mechanical and Functional Properties of Mo—Si—B Ternary Alloys for Ultra-high Temperature Applications", Materia Japan, The Japan Institute of Metals, Feb. 20, 2005, pp. 131-137, vol. 44, No. 2.

S.R. Bakhshi et al., "Preparation of Mo—Si—B nanocomposite powders by mechanical alloying and heat treating", Powder Metallurgy, Apr. 2011, pp. 108-112, vol. 54, No. 2.

Michael R. Middlemas et al., "The Microstructural Engineering of Mo—Si—B Alloys Produced by Reaction Synthesis", JOM, Oct. 2010, pp. 20-24, vol. 62, No. 10.

M. Kruger et al., "Mechanically alloyed Mo—Si—B alloys with a continuous $\alpha$-Mo matrix and improved mechanical properties", Intermetallics, 2008, pp. 933-941, vol. 16.

S.R. Bakhshi et al., "Structural evaluation of Mo—Si—B multiphase alloy during mechanical alloying and heat treatment", Powder Metallurgy, 2008, pp. 119-124, vol. 51, No. 2.

A.R. Abbasi et al., "Synthesis of $Mo_5SiB_2$ based nanocomposites by mechanical alloying and subsequent heat treatment", Material Science and Engineering A, Apr. 2011, pp. 3295-3301, vol. 528.

International Search Report for PCT/JP2012/083218 dated Feb. 12, 2013.

* cited by examiner 03-065-8686 Quality = i

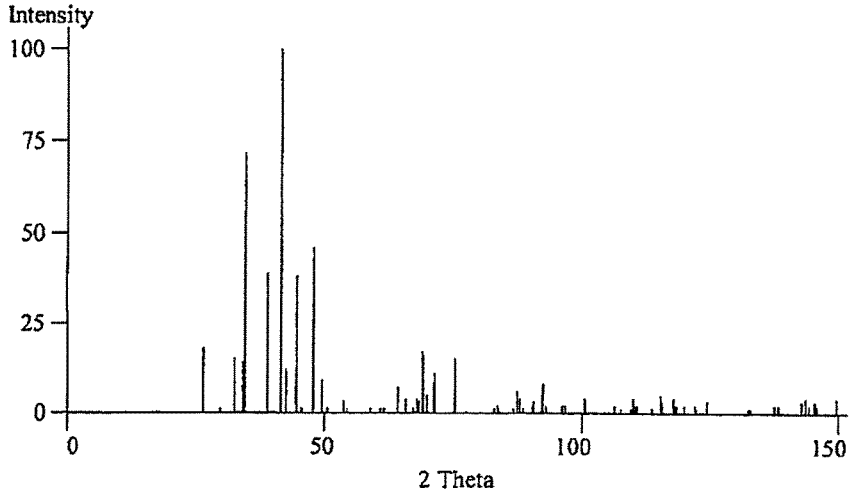

Formula $Mo_5B_2Si$

Name Molybdenum Boron Silicide

Mineral Name

Also Called

Rad. CuKα1 λ 1.54060 Filter d-sp Calculated

Cut off Int. Calculated I/Icor. 5.62

Ref. Check in the systems: Molybda(:)n-silicium-Bor, wolfram-silicium-Bor and in the system: VSi2-TaSi2, Nowotny, H., Dimakopoulou, E., Kudielka, H., Monatsh. Chem., 88, 180 (1957), Calculated from NIST using POWD-12++

Camera Diameter

Author's Parameters:

Sys. Tetragonal S.G. I4/mcm(140) Aspect a 6.013 b c 11.032 A C 1.8347

α β γ Z 4

Volume 398.87 mp

Ref. Ibid.

Dx 8.816 Dm SS/FOM: $F_{30}$=1000(.000,31)

R-factor: Error:

ICDD Calculated Parameters: S.G. I4/mcm(140)

Cell Parameters:

a 6.013 b 6.013 c 11.032 A C 1.8347

α 90 β 90 γ 90 Z 4

Volume 398.87 Molecular Weight 529.41

Reduced Cell:

a 6.013 b 6.013 c 6.965 Volume 199.44

α 115.57 β 115.57 γ 90

FIG. 4

MO—SI—B-BASED ALLOY POWDER, METAL-MATERIAL RAW MATERIAL POWDER, AND METHOD OF MANUFACTURING A MO—SI—B-BASED ALLOY POWDER

CROSS REFERENCE TO RELATED APPLICATIONS

This application is a National Stage of International Application No. PCT/2012/083218 filed Dec. 21, 2012, claiming priority based on Japanese Patent Application No. 2011-288321 filed Dec. 28, 2011, the contents of all of which are incorporated herein by reference in their entirety.

TECHNICAL FIELD

This invention relates to a Mo—Si—B-based alloy powder for use in a heat-resistant material, a metal-material raw material powder using the Mo—Si—B-based alloy powder, and a method of manufacturing the Mo—Si—B-based alloy powder.

BACKGROUND ART

A Mo-based alloy is known as a material for use as a heat-resistant member particularly in a high-temperature environment, such as a friction stir welding tool, a glass melting jig tool, a high-temperature industrial furnace member, a hot extrusion die, a seamless tube manufacturing piercer plug, an injection molding hot runner nozzle, a casting insert mold, a resistance heating deposition container, an airplane jet engine, or a rocket engine.

In order to improve mechanical properties and oxidation resistance at a high temperature, various compounds or the like are added to Mo to thereby obtain Mo-based alloys.

There is known as such an additive a Mo—Si—B-based alloy such as $Mo_5SiB_2$. The properties of the alloy are quite important as a material that largely affects the properties of the heat-resistant member.

Herein, conventionally, the control of the properties of the Mo—Si—B-based alloy has been carried out by selecting/improving a raw material powder, a sintering method, and so on.

For example, in Patent Document 1, a Mo alloy containing a Mo—Si—B-based alloy is manufactured by mechanically alloying a Mo powder, a Si powder, and a B powder to produce a mixed powder and then compacting and heat-treating the obtained mixed powder (Patent Document 1).

Patent Documents 2 and 3 disclose a technique that manufactures a Mo—Si—B-based alloy by melting and rapidly solidifying raw materials and disperses the alloy in a body-centered cubic Mo matrix, thereby forming a material having a 0.2% proof stress of 100 MPa or more at 1300° C. (Patent Documents 2 and 3).

Further, in Patent Document 4, a Mo—Si—B alloy is formed by a plasma spraying method, wherein Mo, Si, and B are constituent elements and a $Mo_3Si$ phase, a $Mo_5Si_3$ phase, and a $Mo_5SiB_2$ phase coexist (Patent Document 4).

The Mo—Si—B-based alloys are manufactured by various methods as described above and are used for friction stir welding components as described in, for example, Patent Document 5 (Patent Document 5).

PRIOR ART DOCUMENT

Patent Document

Patent Document 1: U.S. Pat. No. 7,767,138
Patent Document 2: U.S. Pat. No. 5,595,616

Patent Document 3: U.S. Pat. No. 5,593,156
Patent Document 4: JP-A-2004-115833
Patent Document 5: JP-A-2008-246553

SUMMARY OF THE INVENTION

Problem to be Solved by the Invention

Herein, for example, with respect to friction stir welding, a welding object has been gradually changing from Al and Cu, which were widely used conventionally, to a metal with a higher melting point such as a Fe-based alloy, a FeCr-based alloy (such as stainless), or a Ti-based alloy in recent years. Therefore, a friction stir welding component is required to have physical properties such as higher proof stress adapted to the increase in melting point.

However, there has been a problem that the Mo—Si—B-based alloys described in the above-mentioned documents each have a 0.2% proof stress of about 100 MPa at 1300° C. and thus that none of them satisfy physical properties such as proof stress adapted to such an increase in the melting point of the welding object.

That is, it is a current state that, only by devising the manufacturing methods as conventional, it is difficult to satisfy the physical properties such as proof stress adapted to the increase in the melting point of the welding object.

This invention has been made in view of the above-mentioned problem and it is an object of this invention to provide a Mo—Si—B-based alloy powder for a heat-resistant alloy that has high density and satisfies, more than conventional, physical properties such as proof stress adapted to an increase in the melting point of a welding object.

Means for Solving the Problem

As a result of intensive studies on peak data obtained by X-ray diffraction of Mo—Si—B-based alloy powders in order to solve the above-mentioned problem, the present inventors have obtained knowledge that particularly the full width at half maximum of a peak representing the crystallinity of the powder affects the properties of an alloy.

In general, when the full width at half maximum of a powder is large, this means that strain or defect is introduced in the powder and, when sintering is carried out using such a powder, there is an effect that the strain energy stored in the powder is released to promote the sintering. That is, as a raw material powder for a sintered body, a powder introduced with strain has been considered to be better than a stress-free powder with high crystallinity.

However, as a result of analyzing the relationship between the full width at half maximum of (600) of $Mo_5SiB_2$ in X-ray diffraction data of a Mo—Si—B-based alloy powder and the relative density and high-temperature 0.2% proof stress of a sintered body sintered using the powder as its raw material, the present inventors have found that there are instances where the sintered body is excellent in relative density and high-temperature 0.2% proof stress in a case where the full width at half maximum is made small, compared to a case where the full width at half maximum is made large by introducing strain into the powder. This means that while the introduction of the strain into the powder has an effect of promoting the sintering, excessive introduction of the strain instead decreases the high-temperature strength of the sintered body. The reason that the introduction of the strain decreases the high-temperature strength is that when the strain is excessively introduced to degrade the crystallinity of $Mo_5SiB_2$, the high-temperature strength as the primary property of $Mo_5SiB_2$ cannot be exhibited.

As a result of further intensive studies based on the above-mentioned knowledge, the present inventors have found that the relative density and high-temperature 0.2% proof stress of a sintered body are improved by controlling the full width at half maximum in a certain range, and have completed this invention.

That is, a first aspect of this invention is a Mo—Si—B-based alloy powder characterized by comprising (213), (211), (310), (114), and (204) diffraction peaks of $Mo_5SiB_2$ in X-ray diffraction, wherein the full width at half maximum of a (600) peak of $Mo_5SiB_2$ is 0.08 degrees or more and 0.7 degrees or less.

A second aspect of this invention is a metal-material raw material powder characterized by being a mixed powder comprising the Mo—Si—B-based alloy powder according to the first aspect and a powder of at least one or more kinds selected from the group consisting of Group IVA, VA, and VIA elements.

A third aspect of this invention is a method of manufacturing the Mo—Si—B-based alloy powder according to the first aspect, characterized by comprising, a mixing step of using a Mo powder, a $MoSi_2$ powder, and a MoB powder as raw materials and mixing them in a predetermined mixing ratio, a heat treatment step of heat-treating a mixed powder, obtained by the mixing step, at 1350° C. or more and 1750° C. or less in an atmosphere containing hydrogen or an inert gas such as argon or nitrogen, a disintegration treatment step of disintegrating a powder obtained by the heat treatment step, and a step of sieving a powder obtained by the disintegration treatment step.

Effect of the Invention

According to this invention, it is possible to provide a Mo—Si—B-based alloy powder for a heat-resistant alloy that has high density and satisfies, more than conventional, physical properties such as high-temperature 0.2% proof stress adapted to an increase in the melting point of a welding object.

BRIEF DESCRIPTION OF THE DRAWINGS

FIG. 4 is a diagram showing the peak intensities of $Mo_5SiB_2$ described in ICDD (International Centre for Diffraction Data).

MODE FOR CARRYING OUT THE INVENTION

Figure 1:
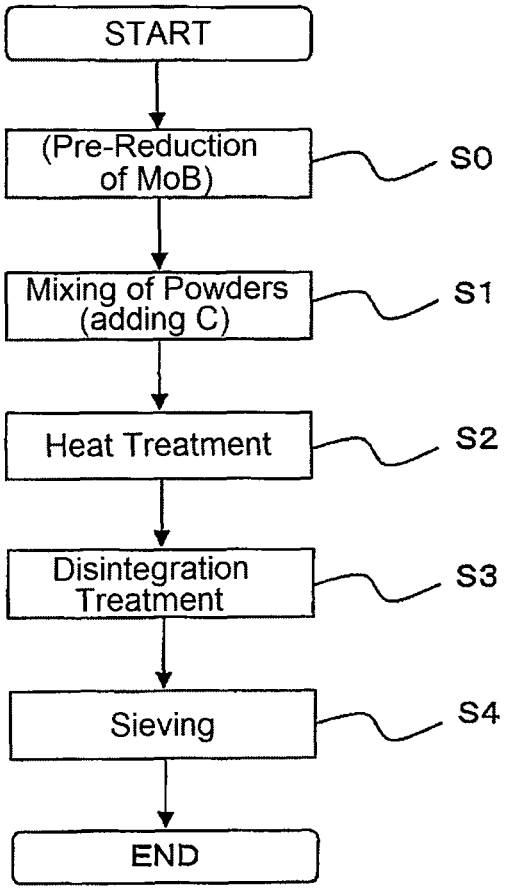
FIG. 1 is a flowchart showing a sequence of manufacturing a Mo—Si—B-based alloy powder of this invention.

Hereinbelow, a preferred embodiment of this invention will be described in detail with reference to the drawings.

As described before, a Mo—Si—B-based alloy powder according to this invention is such that the full width at half maximum of (600) of $Mo_5SiB_2$ in peak data obtained by X-ray diffraction is controlled in a predetermined range. Hereinbelow, the conditions of the Mo—Si—B-based alloy of this invention will be described in detail.

<X-Ray Diffraction Peak Data>

The Mo—Si—B-based alloy powder according to this invention comprises (213), (211), (310), (114), and (204) diffraction peaks of $Mo_5SiB_2$ in the X-ray diffraction peak data.

However, if the full width at half maximum of (600) is less than 0.08 degrees or greater than 0.7 degrees, it is not possible to obtain an effect of increasing the relative density and high-temperature 0.2% proof stress of a sintered material. Therefore, the full width at half maximum of the (600) diffraction peak is preferably 0.08 degrees or more and 0.7 degrees or less and more preferably 0.2 degrees or more and 0.4 degrees or less.

Herein, the reason for paying attention to the full width at half maximum of (600) in the X-ray diffraction is that (600) is a higher-order lattice plane of (100) where, in general, an influence of strain of a crystal tends to appear and that the influence of the strain of the crystal more tends to appear on the higher-order lattice plane. Further, the (600) peak, to which attention is paid in this invention, does not overlap with peaks of other compounds, such as $Mo_3Si$, and Mo and thus is suitable for an analysis of the full width at half maximum.

More preferably, it is satisfactory if the (204) peak intensity is higher than the (114) peak intensity. Accordingly, it is not necessary to agree with the ICDD-described $Mo_5SiB_2$ peak intensity ratio shown in FIG. 4.

Although details will be described later, the full width at half maximum can be controlled, for example, by controlling the heat treatment temperature when producing the alloy powder or by controlling the disintegration (also called pulverization) treatment conditions after the heat treatment.

<Compositions of Mo, Si, and B>

Since the full width at half maximum of (600) of $Mo_5SiB_2$ is controlled in the predetermined range, the Mo—Si—B-based alloy according to this invention contains at least $Mo_5SiB_2$.

However, the Mo—Si—B-based alloy does not necessarily have the perfect component ratio of $Mo_5SiB_2$. While, for example, compounds containing at least two or more kinds of Mo, Si, and B, such as $Mo_3Si$ and $Mo_2B$, may be contained as later-described inevitable compounds due to the preparation of the Mo—Si—B-based alloy powder of this invention, if $Mo_5SiB_2$ is a main component, the effect of this invention can be obtained.

Specifically, the Si content may be 4.2 mass % or more and 5.9 mass % or less and the B content may be 3.5 mass % or more and 4.5 mass % or less. For example, when $Mo_5SiB_2$ is used as the main component of the Mo—Si—B-based alloy, the inevitable compounds such as $Mo_3Si$ and $Mo_2B$ do not affect the density and high-temperature 0.2% proof stress of a sintered body alloy, which are the function and effect of this invention, if the MoB (002) peak intensity is 2% and the $Mo_3Si$ (211) peak intensity is about 6% relative to the $Mo_5SiB_2$ strongest line peak (213) intensity.

As inevitable impurities, there are metal components such as Fe, Ni, and Cr, C, N, and O.

<Powder Particle Size>

The particle size of the Mo—Si—B-based alloy powder according to this invention is preferably 0.05 $m^2/g$ or more and 1.0 $m^2/g$ or less by the BET method (Brunauer, Emmet and Teller's method) in order to enable uniform mixing and dispersion when it is mixed with another powder such as a Mo powder which is used in the manufacture of a sintered body.

This is because if the particle size is less than 0.05 $m^2/g$, remarkably large particles are mixed in primary particles and this hinders uniform mixing and dispersion of the particles into, for example, a Mo powder when the Mo powder is mixed with the alloy powder of this invention so that sufficient alloy properties cannot be obtained.

Further, this is because if the particle size is greater than 1.0 $m^2/g$, primary particles are conversely so small that the particles are aggregated and thus tend to form large secondary particles.

That is, the presence of the aggregated particles makes it difficult to obtain sufficient molding density. Further, if the aggregation proceeds, this hinders uniform mixing and dispersion of the particles into a Mo powder when the Mo powder is mixed with the alloy powder of this invention so that sufficient alloy properties cannot be obtained.

<Oxygen Content>

It has been found that oxygen in the Mo—Si—B-based alloy powder according to this invention has an effect of, when the alloy powder is mixed with a Mo powder and sintered, promoting the sintering of the Mo powder and the alloy powder to increase the grain boundary strength, thereby increasing the high-temperature bending strength of a sintered material. As a result of investigation by the present inventors, it is preferable that the oxygen content be 200 mass ppm or more and 45000 mass ppm or less. In order to further promote the sintering and prevent remaining of pores, the oxygen content is more preferably 840 mass ppm or more and 21600 mass ppm or less.

Although details will be described later, the oxygen content can be controlled by heat treatment step conditions for the Mo—Si—B-based alloy powder or by a pre-reduction treatment of particularly a MoB powder among raw material powders.

<Carbon Content>

Carbon in the Mo—Si—B-based alloy powder according to this invention has effects of, when the alloy powder is mixed with, for example, a Mo powder thereby to manufacture a sintered body, not only removing oxygen present in raw material powders of the alloy, but also promoting sintering of a Mo base phase to increase the grain boundary strength, thereby increasing the high-temperature bending strength of the sintered material. However, if oxygen in the Mo—Si—B-based alloy powder is excessively removed, an effect of promoting sintering between the Mo—Si—B-based alloy powder and the Mo powder is decreased. Therefore, the carbon content is preferably 50 mass ppm or more and 1000 mass ppm or less and more preferably 80 mass ppm or more and 220 mass ppm or less as a range that further promotes the sintering.

Although details will be described later, the carbon content may be due to the presence of carbon as an inevitable impurity in the raw materials of the Mo—Si—B-based alloy powder of this invention or may be due to intentional addition of a carbon source.

That is, carbon is not necessarily in a state of being chemically bonded to the Mo—Si—B-based powder alloy and may be free carbon. There is a possibility that carbon as an inevitable impurity may be incorporated from a metal or ceramic member of a mixer, a heat treatment apparatus, or a disintegration apparatus or the like. When carbon is added as free carbon, it is possible to use, apart from a single-element substance such as carbon black, graphite, carbon fiber, fullerene, or diamond, an organic material, a solvent, or a combination of two or more kinds of organic materials and/or solvents.

The mechanism in which the relative density and high-temperature 0.2% proof stress of the sintered body are improved when oxygen and carbon are contained in the Mo—Si—B-based alloy powder can be considered as follows.

When a Mo—Si—B-based alloy powder with a high oxygen content is mixed with a Mo powder and sintered, oxygen in the Mo—Si—B-based alloy powder reacts with the Mo powder to produce molybdenum trioxide $MoO_3$. Since the melting point of $MoO_3$ is known to be about 800° C., it is considered that $MoO_3$ reaches the melting point before reaching a later-described alloy sintering temperature to percolate through the Mo powder and between the Mo powder and the Mo—Si—B-based alloy powder, thereby improving the wettability of the powders to promote the sintering.

Since a formed $MoO_3$ phase is gradually reduced during the sintering in a hydrogen atmosphere to be finally a Mo phase, the possibility is very low that $MoO_3$ is detected in a sintered material or that $MoO_3$ decreases the room-temperature hardness or high-temperature strength of a sintered material. While it is considered that $MoO_3$ may partially evaporate, fresh Mo surfaces appear at places where $MoO_3$ disappeared and therefore it is considered that the sintering is promoted even in this case.

It may be considered to add a necessary amount of a $MoO_3$ powder as a raw material of a sintering alloy in order to obtain this effect. However, unless this $MoO_3$ powder is present between Mo and a Mo—Si—B-based alloy powder which are different kinds of substances, the sintering promoting effect is difficult to obtain. Further, if added as the $MoO_3$ powder, it is also considered that uniform dispersion of the $MoO_3$ powder over the entirety is difficult because of its extremely small amount. Therefore, in order to improve the sinterability to improve the density of a sintered body, the Mo—Si—B-based alloy powder with oxygen is considered to be more preferable.

Carbon in the Mo—Si—B-based alloy is considered to be an important component that contributes to reduction of $MoO_3$. The carbon component, as will be described later, can be added in a mixing step before sintering the alloy, but, in terms of uniformity of component dispersion, it is preferable that the carbon component be contained in advance in the Mo—Si—B alloy powder as in this invention.

$MoO_3$ is produced at 400° C. or more while $Mo_2C$ is produced at 1100° C. or more. Accordingly, the possibility is very low that a carbide of Mo is produced before an oxide of Mo is produced. Thus, the above-mentioned wettability effect is obtained.

From the above, it is considered to be preferable to contain oxygen and carbon in the Mo—Si—B-based alloy powder in order to allow them to selectively act between the Mo powder and the Mo—Si—B-based alloy powder.

The conditions of the Mo—Si—B-based alloy powder of this invention are as described above.

<Manufacturing Method>

Next, a method of manufacturing the Mo—Si—B-based alloy powder of this invention will be described.

The method of manufacturing the Mo—Si—B-based alloy powder of this invention is not particularly limited as long as it can manufacture an alloy that satisfies the above-mentioned conditions. However, a method shown in FIG. 1 can be given as an example.

First, raw material powders are mixed in a predetermined ratio to produce a mixed powder (S1 in FIG. 1).

As the raw materials, there can be cited a Mo powder, a $MoSi_2$ powder, and a MoB powder. If necessary, a carbon powder is added to control the carbon content of the alloy powder.

The MoB powder reacts with oxygen more readily than the Mo powder or the $MoSi_2$ powder and thus has a possibility that its oxygen content during the storage largely changes compared to the other powders.

In order to stabilize the oxygen content of the alloy powder resulting from the oxygen content of the raw materials, the MoB powder is preferably subjected to a pre-reduction treatment (S0 in FIG. 1).

The reason is that when MoB is stored for a long period of time or exposed to a high humidity environment, its oxygen content may increase to about 10 mass %. Even with the oxygen content of this degree, it can be used as a raw material according to the manufacturing method of this invention.

However, by carrying out the pre-reduction treatment, it is possible to stabilize the oxygen content of the Mo—Si—B-based alloy powder.

The oxygen content of the MoB powder for use as a raw material powder of the Mo—Si—B-based alloy powder is preferably 5 mass % or less, more preferably 2 mass % or less, and further preferably 1 mass % or less. Since this step aims to reduce MoB, a hydrogen atmosphere is used.

If the temperature of the pre-reduction is less than 900° C., the reduction effect is not sufficient. If it is higher than 1300° C., there is a problem that the MoB powder is baked to adhere to a boat, with the powder placed therein, in a heat treatment, thus lowering the yield.

Therefore, the temperature of the pre-reduction is preferably 900° C. to 1300° C., which makes it possible to obtain a stable reduction effect and to obtain a high recovery rate.

In order to obtain a more stable reduction effect and recovery rate, the temperature of the pre-reduction is more preferably 1100° C. or more and 1200° C. or less.

Then, the mixed powder is heat-treated in an atmosphere containing hydrogen or an inert gas such as argon or nitrogen (S2 in FIG. 1). The pressure during heating is set to an atmospheric pressure.

Specifically, the heat treatment is preferably carried out at 1350° C. or more and 1750° C. or less.

This is because if the heating temperature is less than 1350° C., even if heating is carried out for a long time, the amount of impurities such as MoB increases and thus, if sintering is carried out using this as a raw material, lower mechanical strength is resulted, and because if the heating temperature is higher than 1750° C., sintering proceeds to increase the size of particles and to improve the crystallinity so that the full width at half maximum of (600) of $Mo_5SiB_2$ becomes too small. Further, this is also because there is a possibility of causing an increase in treatment time in a later-described disintegration step. That is, the first control point of the full width at half maximum control of this invention is the heat treatment conditions.

The powder obtained by the heat treatment step is in a slightly aggregated state and thus is then subjected to a disintegration treatment (S3 in FIG. 1).

Finally, the powder obtained by the disintegration treatment step is sieved, thereby extracting a powder of the above-mentioned particle size (S4 in FIG. 1).

Herein, while the heat-treated powder is aggregated and thus needs to be disintegrated and sieved, if a large external force is applied to the powder particularly under disintegration conditions, strain occurs in the powder so that there are instances where the powder with a full width at half maximum in the range of this invention is not obtained. Basically, it is preferable to control the crystallinity in the heat treatment step and to set conditions, which prevent the occurrence of strain that causes a full width at half maximum outside the range of this invention, in the disintegration step as a second control point of the full width at half maximum control. For example, as a disintegration method, it is preferable to carry out disintegration using a mortar or a ball mill with a Mo-coated inner surface by setting the container rotational speed to be low and the treatment time to be short.

When, depending on the case, the treatment is carried out for a long time in the upper-limit temperature range in the heating step, the powder of this invention can be obtained by adjusting the disintegration conditions even if strain is imparted. A disintegration apparatus to be used may be a known one such as a mortar or a ball mill and the conditions may be appropriately adjusted.

The above-mentioned steps are the method of manufacturing the Mo—Si—B-based alloy powder of this invention.

As described above, according to the Mo—Si—B-based alloy of this invention, by controlling the full width at half maximum of (600) of $Mo_5SiB_2$ in the predetermined range, the powder introduced with strain is obtained so that the sintering is promoted, thus making it possible to obtain the high-density sintered body, and further, since the strain is imparted in the range that maintains the crystallinity, the high-temperature strength as the primary property of $Mo_5SiB_2$ can be exhibited. Consequently, it is possible to satisfy, more than conventional, physical properties such as high-temperature 0.2% proof stress required for a friction stir welding tool adapted to an increase in the melting point of a welding object.

<Mixed Powder of Mo—Si—B-Based Alloy Powder and Metal Powder>

The Mo—Si—B-based alloy powder of this invention can be used as a heat-resistant member by being mixed with a powder of at least one kind selected from the group consisting of Group IVA, VA, and VIA elements, such as a powder of at least one kind of Mo, W, Ta, Nb, and Hf, and then sintered.

In this event, the weight mixing ratio of the Mo—Si—B-based alloy powder with respect to the powder of at least one kind selected from the group consisting of the Group IVA, VA, and VIA elements is preferably set to 0.25 or more and 4.0 or less relative to Mo.

For example, if the mixing ratio of the Mo—Si—B-based alloy powder to Mo is less than 0.25, the 0.2% proof stress approaches as low as that of Mo so that it is not suitable for a friction stir welding tool which is one of uses of this invention. On the other hand, if it is greater than 4.0, the moldability is degraded to cause the density of a sintered body to be low so that the sintering cannot be achieved. Since the Mo—Si—B-based alloy is a very hard material, if its weight ratio becomes greater than that, sintering between the Mo—Si—B-based alloy powder particles occurs more often than sintering through the Mo particles, which increases the possibility of the formation of pores. On the other hand, if the mixing ratio of the Mo—Si—B-based alloy powder to Mo exceeds 1.3, the hardness of a sintered body becomes high so that it exhibits a better effect as an abrasion-resistant material, but, since it is fragile, the range is more preferably set to 0.25 or more and 1.3 or less as a range for use that also requires ductility.

When, for example, a powder of at least one kind of W, Ta, Nb, and Hf is mixed in addition to Mo, such at least one kind of W, Ta, Nb, and Hf may be mixed so as to be equal to a volume ratio of Mo and the Mo—Si—B-based alloy when the mixing ratio of the Mo—Si—B-based alloy powder to Mo is 0.25 to 4.0.

Herein, the measurement conditions for various properties in this invention will be described.

<X-Ray Diffraction Conditions for Powder of this Invention>

Apparatus: X-ray diffraction apparatus (model number: RAD-IIB) manufactured by Rigaku Corporation Vessel: Cu (KαX-ray diffraction)

Opening Angle of Divergence Slit and Scattering Slit: 1°

Opening Width of Receiving Slit: 0.3 mm

Opening Width of Receiving Slit for Monochromator: 0.6 mm

Tube Current: 30 mA

Tube Voltage: 40 kV

Scanning Speed: 1.0°/min

<Oxygen Content and Carbon Content of Powder of this Invention>

Then, the oxygen content of the Mo—Si—B-based alloy powder was measured using an oxygen analyzer "TC600" manufactured by LECO Corporation while the carbon content thereof was measured using a carbon/sulfur analyzer "EMIA-810" manufactured by HORIBA, Ltd.

<Particle Size of Powder of this Invention>

The powder particle size was measured using a surface area measuring apparatus "MONOSORB" manufactured by Spectris Co., Ltd.

<Calculation Method of Relative Density of Sintered Body Manufactured Using Powder of this Invention>

The relative density was obtained in the following manner. The relative density referred to herein is a value expressed in % by dividing a density measured for a manufactured sample (bulk) by its theoretical density.

Hereinbelow, a specific measurement method will be described.

(Measurement of Bulk Density)

The bulk density was obtained by the Archimedes method. Specifically, the weights in air and water were measured and the bulk density was obtained using the following calculation formula.

$$\text{bulk density}=\text{weight in air}/(\text{weight in air}-\text{weight in water})\times\text{density of water}$$

(Measurement of Theoretical Density)

First, the theoretical density of a Mo—$Mo_5SiB_2$ alloy was obtained by the following sequence.

(1) Mo, Si, and B in the bulk were measured in mass % by ICP-AES and those values were converted to mol %.

Figure 2:
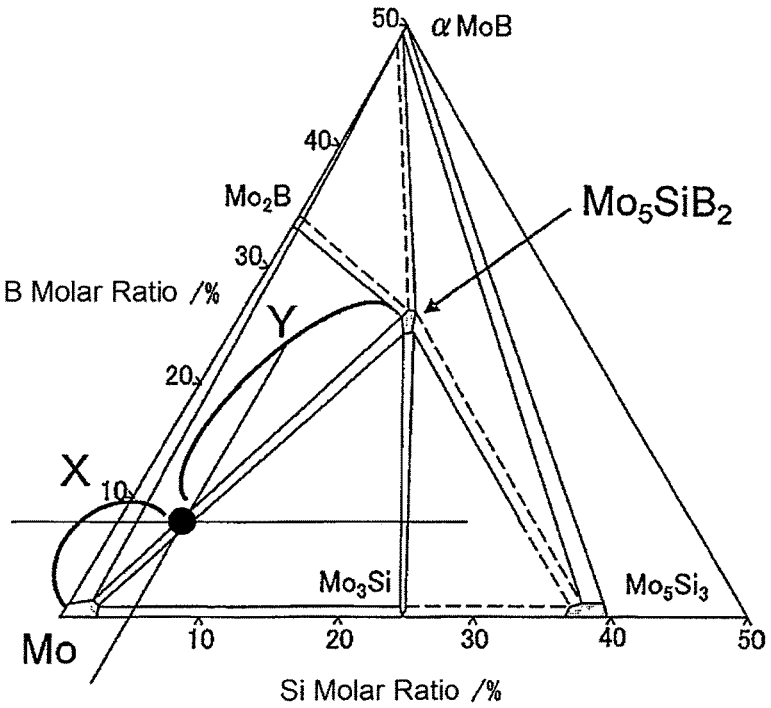
FIG. 2 is a diagram showing a Mo—Si—B ternary phase diagram (source: Nunes, C. A., Sakidja, R. & Perepezko, J. H.: Structural Intermetallics 1997, ed. by M. V. Nathal, R. Darolia, C. T. Liu, P. L. Martin, D. B. Miracle, R. Wagner and M. Yamaguchi, TMS (1997), 831-839.).

(2) A composition point in mol % of Si and B was plotted on a ternary phase diagram shown in FIG. 2 (see a black circle in FIG. 2). Since the composition of the bulk is mostly Mo and $Mo_5SiB_2$, the plotted point is on a straight line connecting between a composition point of $Mo_5SiB_2$ and a composition point of Mo 100%.

(3) As shown in FIG. 2, given that the distance between the plotted point and the composition point of Mo 100% is X and that the distance between the plotted point and the composition point of $Mo_5SiB_2$ is Y, the ratio of X and Y is converted to 100%. By this conversion, X represents a molar ratio of $Mo_5SiB_2$ and Y represents a molar ratio of Mo.

(4) The atomic weight of Mo is given as a (=95.94 g/mol), the atomic weight of $Mo_5SiB_2$ is given as b (=105.9 g/mol), the density of Mo is given as Ma (=10.2 g/cm$^3$), and the density of a bulk member of $Mo_5SiB_2$ ideally adjusted in composition is given as Mb (=8.55 g/cm$^3$).

(5) Herein, the mass ratio of $Mo_5SiB_2$ to Mo is expressed as follows.

$$Mo_5SiB_2:Mo=X\cdot b:Y\cdot a$$

Thus, the mass of the entire alloy is expressed as follows.

$$\text{mass of entire alloy}=X\cdot b+Y\cdot a$$

The volume of the entire alloy is expressed as follows.

$$\text{volume of entire alloy}=(X\cdot b/Mb)+(Y\cdot a/Ma)$$

Therefore, the density of the alloy is obtained by mass of entire alloy/volume of entire alloy so that $$\text{theoretical density } Mt=(X\cdot b+Y\cdot a)/[(X\cdot b/Mb)+(Y\cdot a/Ma)].$$

<Measurement of Hardness of Sintered Body Manufactured Using Powder of this Invention>

Using a micro Vickers hardness tester (model number: AVK) manufactured by Akashi Corporation, the Vickers hardness of the heat-resistant alloy was measured by applying a measurement load of 20 kg at 20° C. in the atmosphere. The number of measurement points was set to 5 and the average value was calculated.

<0.2% Proof Stress of Sintered Body Manufactured Using Powder of this Invention>

The 0.2% proof stress of the heat-resistant alloy was measured by the following sequence.

First, the sintered body was machined to a length of about 25 mm, a width of about 2.5 mm, and a thickness of about 1.0 mm and its surfaces were polished using #600 SiC polishing paper.

Then, the sample was set in a high-temperature universal testing machine (model number: 5867 type) manufactured by Instron Corporation so that the distance between pins was set to 16 mm. Then, a three-point bending test was conducted at 1200° C. in an Ar atmosphere by pressing a head against the sample at a crosshead speed of 1 mm/min, thereby measuring the 0.2% proof stress.

EXAMPLES

Hereinbelow, this invention will be described in further detail with reference to Examples.

Example 1

Evaluation of Full Width at Half Maximum by X-Ray Diffraction of Powder

First, Mo—Si—B-based alloy powders with different full widths at half maximum of (600) were manufactured and then were each mixed with a Mo powder. Then, sintered bodies were manufactured and the relative density and 0.2% proof stress thereof were measured. The specific sequence was as follows.

First, Mo—Si—B-based alloy powders were manufactured.

Specifically, a Mo powder having a purity of 99.99 mass % or more, an average particle size according to Fsss of 4.8 μm, and an oxygen content of 580 ppm, a $MoSi_2$ powder having an average particle size according to Fsss of 8.1 μm and an oxygen content of 8250 ppm, and a MoB powder having an average particle size according to Fsss of 8.1 μm were prepared in a ratio of 43.4:14.3:42.3 in mass % and mixed together in a mortar, thereby producing a mixed powder.

Since the oxygen content of the MoB powder was 78200 mass ppm, a heat treatment was carried out at 1150° C. in a hydrogen atmosphere for reduction to decrease the oxygen content to 19800 mass ppm and then the MoB powder was used in the mixing of the powders.

Then, the obtained mixed powder was subjected to a heat treatment at 1250° C. to 1800° C. in a hydrogen atmosphere for 1 hour, thereby obtaining an alloy powder. By changing the heat treatment temperature in this step, the full width at half maximum of (600) of $Mo_5SiB_2$ can be controlled. In the temperature range of 1250° C. to 1800° C., the full width at half maximum becomes maximum at the lowest temperature of 1250° C., the full width at half maximum shows a tendency to decrease as the temperature increases, and the full width at half maximum becomes minimum at the highest temperature of 1800° C.

Then, 50 g of the obtained alloy powder was subjected to a disintegration treatment for 15 minutes to 120 minutes using a mortar. The mortar was made of agate and its rotational speed was set to 7 rpm. A pestle was also made of agate and its rotational speed was set to 120 rpm. The full width at half maximum of (600) of $Mo_5SiB_2$ can also be controlled by changing the disintegration time in this step. In the disintegration time range of 15 minutes to 120 minutes, the full width at half maximum becomes minimum in the case of the shortest disintegration time of 15 minutes, the full width at half maximum shows a tendency to increase as the disintegration time increases, and the full width at half maximum becomes maximum in the case of the longest disintegration time of 120 minutes.

Finally, the powders in which the full widths at half maximum of (600) of $Mo_5SiB_2$ were controlled by the heating temperature and the disintegration time as described above were each sieved through a #60 sieve, thereby manufacturing Mo—Si—B-based alloy powders with full widths at half maximum of (600) of $Mo_5SiB_2$ being 0.05 degrees to 0.8 degrees.

Then, each of the manufactured Mo—Si—B-based alloy powders in an amount of 44 mass %, a 54 mass % Mo powder, and a 2 mass % $MoSi_2$ powder were mixed together and then compression-molded under the conditions of a temperature of 20° C. and a molding pressure of 3 ton/cm$^2$ using a uniaxial pressing machine, thereby obtaining compacts.

Then, sintered bodies were manufactured by normal-pressure hydrogen sintering at 1800° C.

Table 1 shows full widths at half maximum of the manufactured Mo—Si—B-based alloy powders and relative densities and 0.2% proof stresses at a high temperature (1200° C.) of the manufactured sintered bodies.

TABLE 1

| | | This Invention | | | | | Comparative Examples | | | |
|---|---|---|---|---|---|---|---|---|---|---|
| | | powder 1 | 2 | 3 | 4 | 5 | powder A | B | C | D |
| Powder | $Mo_5SiB_2$(600) full width at half maximum deg. | 0.67 | 0.35 | 0.21 | 0.12 | 0.08 | 0.05 | 0.8 | 0.04 | 1.0 |
| | Si content mass % | 5.8 | 5.8 | 5.9 | 5.6 | 5.6 | 4.2 | 5.9 | 5.3 | 5.3 |
| | B content mass % | 4.2 | 4.1 | 4.2 | 4.3 | 4.0 | 3.5 | 4.5 | 4.1 | 4.2 |
| | BET m$^2$/g | 0.17 | 0.21 | 0.15 | 0.14 | 0.13 | 0.18 | 0.21 | 0.3 | 0.1 |
| Powder Manufacturing Conditions | heating temperature ° C. | 1450 | 1550 | 1650 | 1650 | 1650 | 1800 | 1250 | atomizing method | MA |
| | heating time min. | 60 | 60 | 60 | 60 | 60 | 60 | 60 | | |
| | disintegration time min. | 15 | 15 | 60 | 30 | 15 | 15 | 15 | | |
| Sintered Body | relative density % | 99.5 | 98.7 | 98.9 | 98.6 | 98.1 | 97.1 | 96.2 | 94.5 | 92.1 |
| | 0.2% proof stress at high temperature MPa | 652 | 778 | 813 | 785 | 772 | 582 | 590 | 544 | 521 |

Figure 3:
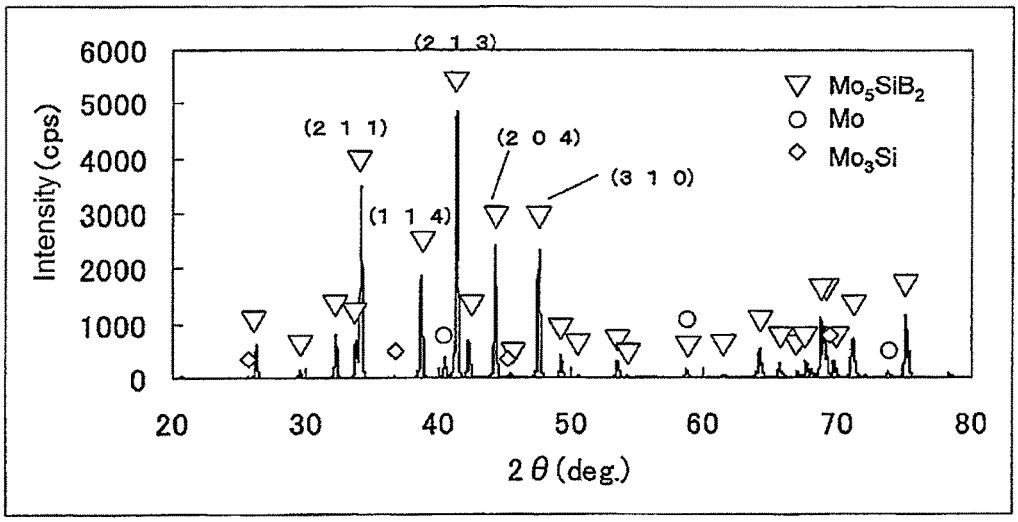
FIG. 3 is a diagram showing the X-ray diffraction results of a Mo—Si—B-based alloy powder of this invention.

FIG. 3 shows the results of carrying out X-ray diffraction under the aforementioned conditions with respect to a powder 4 in Table 1.

As shown in this figure, the manufactured Mo—Si—B-based alloy powder had (213), (211), (310), (114), and (204) diffraction peaks of $Mo_5SiB_2$ and these peaks also agreed with ICDD-described peaks of $Mo_5SiB_2$ shown in FIG. 4. Accordingly, it was made clear that the obtained alloy contained $Mo_5SiB_2$ as a main component.

It was also seen that the (204) peak intensity was higher than the (114) peak intensity.

Figure 5:
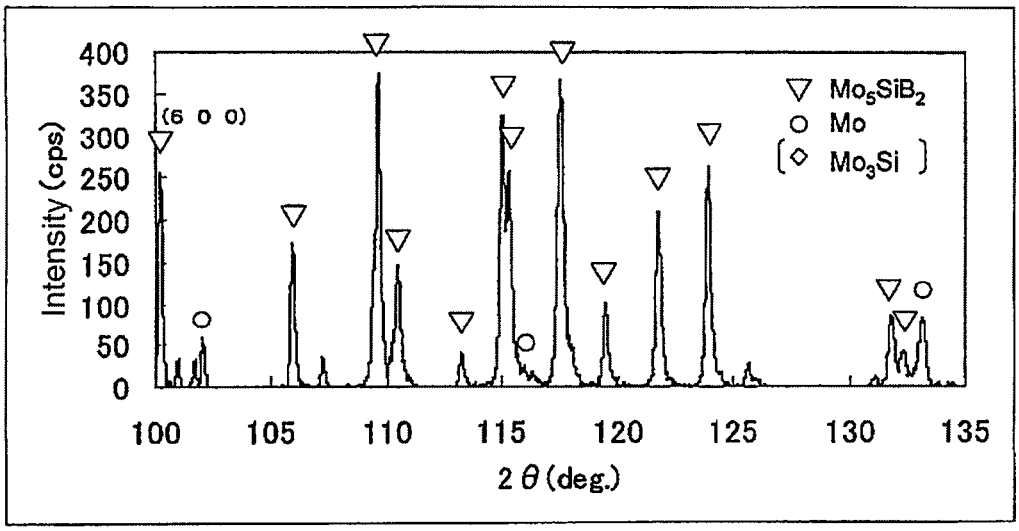
FIG. 5 is a diagram showing peak data which are the X-ray diffraction results of a Mo—Si—B-based alloy powder of this invention obtained by slow scanning on the high-angle side.
Figure 6:
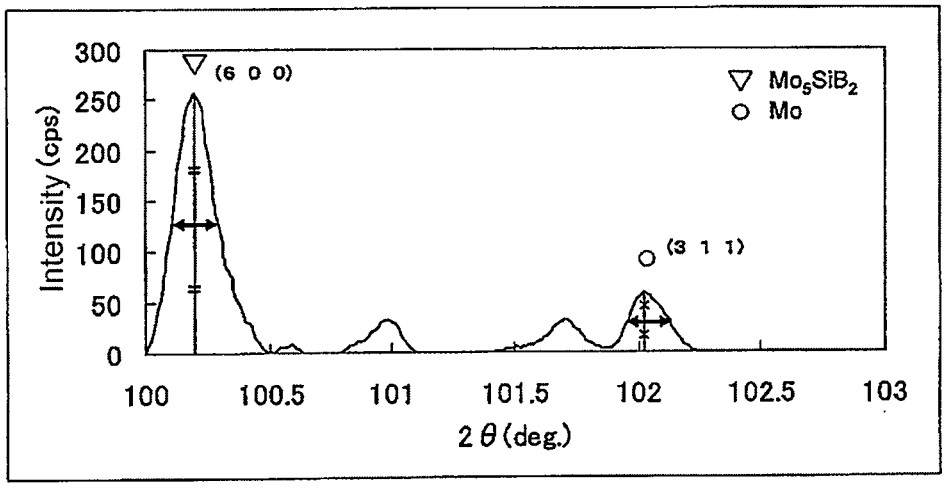
FIG. 6 is a diagram showing a method of obtaining a full width at half maximum.

Further, in order to evaluate the full width at half maximum, slow scanning at 2θ=100 degrees to 135 degrees was carried out by setting the scanning speed to 0.5°/min while the other conditions were the same as those described before, thereby obtaining peak data of FIG. 5. The full width at half maximum of (600) in this figure was obtained by extracting the full width of the peak at a position half the peak intensity as shown in FIG. 6. As a result, it was 0.21 degrees and, likewise, it was seen that all the powders of this invention were in the range of 0.08 degrees or more and 0.7 degrees or less. On the other hand, in the case of a powder A shown as a Comparative Example in which the heating temperature as one of the manufacturing conditions was higher than 1750° C. or in the case of a powder B shown as a Comparative Example in which the heating temperature was less than 1350° C., it was seen that the full width at half maximum of (600) was outside the range of this invention so that the relative density was decreased and the 0.2% proof stress at a high temperature (1200° C.) was also decreased.

On the other hand, a powder C as a Comparative Example according to another manufacturing method is an example in which there was first prepared a powder obtained by mixing together a 90.6 mass % Mo powder (Fsss: 4.8 μm), a 5.3 mass % Si powder (Fsss: 10 μm), and a 4.1 mass % B powder (Fsss: 15 μm) and then a Mo—Si—B-based alloy powder was manufactured by a gas atomizing method. On the other hand, a powder D as a Comparative Example according to still another manufacturing method is an example in which a powder obtained by mixing together a 90.6 mass % Mo powder (Fsss: 4.8 μm), a 5.3 mass % Si powder (Fsss: 10 μm), and a 4.1 mass % B powder (Fsss: 15 μm) was placed in a container and then a MA treatment was carried out in a vibrating ball mill using steel balls as media while subjected to argon gas substitution. These powders manufactured by the existing methods were also subjected to sintering under the same sintering conditions as in Example 1, thereby manufacturing sintered bodies. It was seen that, with respect to the powder C, the full width at half maximum of (600) of $Mo_5SiB_2$ was less than 0.08 degrees while, with respect to the powder D, it was greater than 0.7 degrees, so that the relative density was decreased and the high-temperature 0.2% proof stress was also significantly decreased in each of the cases.

time increases, or as the disintegration time decreases, the powder particle size increases so that a particle size value obtained by the BET method decreases. On the other hand, as the heating temperature decreases, as the heating time decreases, or as the disintegration time increases, the powder particle size decreases so that a particle size value obtained by the BET method increases.

Using the thus manufactured Mo—Si—B-based alloy powders with the particle sizes of 0.03 to 1.5 $m^2/g$ according to the BET method, each of these Mo—Si—B-based alloy powders in an amount of 44 mass %, a 54 mass % Mo powder, and a 2 mass % $MoSi_2$ powder were mixed together and then compression-molded under the conditions of a temperature of 20° C. and a molding pressure of 3 $ton/cm^2$ using a uniaxial pressing machine, thereby obtaining compacts in the same manner as described before.

Then, sintered bodies were manufactured by normal-pressure hydrogen sintering at 1800° C.

Table 2 shows compositions of the manufactured Mo—Si—B-based alloy powders and relative densities and 0.2% proof stresses at a high temperature (1200° C.) of the manufactured sintered bodies.

TABLE 2

| | | | | | | |
|---|---|---|---|---|---|---|
| Powder Analysis Values | BET $m^2/g$ | 0.03 | 0.05 | 0.17 | 1.0 | 1.5 |
| | Si mass % | 5.3 | 5.8 | 5.8 | 5.6 | 5.7 |
| | B mass % | 4.0 | 3.9 | 4.2 | 4.1 | 3.9 |
| Powder Manufacturing Conditions | heating temperature ° C. | 1750 | 1450 | 1650 | 1650 | 1450 |
| | heating time min. | 120 | 60 | 60 | 60 | 60 |
| | disintegration time min. | 5 | 10 | 60 | 90 | 120 |
| Sintered Body | relative density % | 96.2 | 98.1 | 98.9 | 97.7 | 96.5 |
| | 0.2% proof stress MPa (1200° C.) | 661 | 762 | 777 | 754 | 663 |
| | | (Comparative Example) | (Example) | (Example) | (Example) | (Comparative Example) |

As is clear from these results, it was seen that the relative density and high-temperature 0.2% proof stress of the sintered body using the Mo—Si—B-based alloy powder were increased by controlling the full width at half maximum of (600) of $Mo_5SiB_2$ in the range of 0.08 degrees or more and 0.7 degrees or less.

<Evaluation of Influence of Powder Particle Size>

Then, Mo—Si—B-based alloy powders with different powder particle sizes were manufactured by adjusting the heating conditions and the disintegration conditions and then were each mixed with a Mo powder. Then, sintered bodies were manufactured and the relative density and 0.2% proof stress thereof were measured. The specific sequence was as follows.

First, Mo—Si—B-based alloy powders were manufactured, wherein the full width at half maximum of (600) of $Mo_5SiB_2$ was in the range of 0.08 degrees to 0.7 degrees and the powder particle size was 0.03 $m^2/g$ to 1.5 $m^2/g$ in terms of specific surface area measured by the BET method. Herein, the powder particle size can be controlled by the heating temperature, the heating time, or the disintegration time. As the heating temperature increases, as the heating As is clear from Table 2, both the relative density and the 0.2% proof stress at a high temperature (1200° C.) of the sintered body using the Mo—Si—B-based alloy powder in the range of 0.05 $m^2/g$ or more and 1.0 $m^2/g$ or less were higher than those outside this range and particularly the 0.2% proof stress was higher by 100 MPa or more.

From these results, it was seen that the relative density and 0.2% proof stress of the sintered body using the Mo—Si—B-based alloy powder were increased by controlling the powder particle size.

<Evaluation of Influence of Oxygen Content and Carbon Content>

Then, using Mo—Si—B-based alloy powders with oxygen contents of 190 ppm to 45300 ppm and carbon contents of 40 ppm to 1050 ppm, each of these Mo—Si—B-based alloy powders in an amount of 44 mass %, a 54 mass % Mo powder, and a 2 mass % $MoSi_2$ powder were mixed together and then compression-molded under the conditions of a temperature of 20° C. and a molding pressure of 3 $ton/cm^2$ using a uniaxial pressing machine, thereby obtaining compacts in the same manner as described before. The Mo—

Si—B-based alloy powders used herein were such that the full width at half maximum of (600) of $Mo_5SiB_2$ was in the range of 0.08 degrees to 0.5 degrees and that the powder particle size was 0.05 $m^2/g$ to 1.0 $m^2/g$ according to the BET method. Herein, since the oxygen content of the Mo—Si—B-based alloy powder is affected by the oxygen content of raw material powders to be used, particularly the oxygen content of a MoB powder, it can be controlled by the heating temperature in a pre-reduction treatment of the MoB powder or the amount of a carbon powder to be introduced in the pre-reduction treatment. The carbon content of the Mo—Si—B-based alloy powder can be controlled by the amount of the carbon powder to be introduced in the pre-reduction treatment of the MoB powder.

Then, sintered bodies were manufactured by normal-pressure hydrogen sintering at 1800° C.

Table 3 shows oxygen contents and carbon contents of the manufactured Mo—Si—B-based alloy powders and relative densities and 0.2% proof stresses of the manufactured sintered bodies.

TABLE 3

| | Mo—Si—B-Based Alloy Powder | | Sintered Body (Mo—Si—B-based alloy powder + Mo powder) | | Powder Manufacturing Conditions | | |
|---|---|---|---|---|---|---|---|
| | oxygen content ppm | carbon content ppm | relative density % | 0.2% proof stress at high temperature MPa | heating temperature ° C. | heating time min. | disintegration time min. |
| This Invention | 200 | 50 | 98.2 | 717 | 1750 | 120 | 15 |
| | 840 | 220 | 98.6 | 785 | 1550 | 60 | 15 |
| | 9600 | 90 | 98.3 | 752 | 1650 | 60 | 30 |
| | 14800 | 150 | 98.9 | 777 | 1650 | 60 | 60 |
| | 21600 | 80 | 98.7 | 778 | 1550 | 60 | 60 |
| | 45000 | 1000 | 98.1 | 721 | 1450 | 60 | 90 |
| Comparative Examples | 190 | 100 | 93.5 | 605 | 1800 | 60 | 15 |
| | 45300 | 100 | 90.7 | 601 | 1450 | 60 | 180 |
| | 1000 | 40 | 91.5 | 652 | 1800 | 120 | 300 |
| | 1000 | 1050 | 89.6 | 636 | 1100 | 60 | 5 |

As is clear from Table 3, in the case of the sintered body using the Mo—Si—B-based alloy powder whose oxygen content was in the range of 200 mass ppm or more and 45000 mass ppm or less and whose carbon content was in the range of 50 mass ppm or more and 1000 mass ppm or less, the relative density was higher by 5% or more and the 0.2% proof stress was higher by 100 MPa or more compared to the sintered body using the powder outside this range. Further, it was seen that the sintered body using the Mo—Si—B-based alloy powder whose oxygen content was 840 mass ppm or more and 21600 mass ppm or less within the above-mentioned range and whose carbon content was 80 mass ppm or more and 220 mass ppm or less within the above-mentioned range was further increased in 0.2% proof stress.

From these results, it was seen that the relative density and 0.2% proof stress at a high temperature (1200° C.) of the sintered body using the Mo—Si—B-based alloy powder were increased by controlling the oxygen content and the carbon content.

<Weight Mixing Ratio of Raw Material Powders when Manufacturing Sintered Body Using Powder of this Invention>

Then, sintered bodies were manufactured by setting the weight mixing ratio of a Mo—Si—B-based alloy powder to a Mo powder to 0.2 to 5.0 and the relative density and 0.2% proof stress at a high temperature (1200° C.) thereof were measured. The specific sequence was as follows.

First, a Mo—Si—B-based alloy powder was manufactured, wherein the full width at half maximum of (600) of $Mo_5SiB_2$ was in the range of 0.08 degrees to 0.5 degrees and the powder particle size was 0.05 $m^2/g$ to 1.0 $m^2/g$ according to the BET method.

The manufactured Mo—Si—B-based alloy powder and a Mo powder were mixed together in weight mixing ratios of the Mo—Si—B-based alloy powder to the Mo powder from 0.2 to 5.0 and then compression-molded under the conditions of a temperature of 20° C. and a molding pressure of 3 $ton/cm^2$ using a uniaxial pressing machine, thereby obtaining compacts in the same manner as described before.

Then, when the weight mixing ratio of the Mo—Si—B-based alloy powder to the Mo powder was less than 1.5, a sintered body was manufactured by normal-pressure hydrogen sintering at 1800° C., while, when it was 1.5 or more, a sintered body was manufactured by hot pressing at a sintering temperature of 1750° C. at a pressure of 50 MPa.

Table 4 shows weight mixing ratios of the Mo—Si—B-based alloy powder to the Mo powder, relative densities, room-temperature hardnesses, 0.2% proof stresses at a high temperature (1200° C.), and bending strengths of the manufactured sintered bodies.

TABLE 4

| | Weight Mixing Ratio of Mo—Si—B-Based Alloy Powder to Mo Powder | Relative Density of Sintered Body % | Room-Temperature Hardness of Sintered Body Hv | High-Temperature Strength of Sintered Body 0.2% proof stress MPa | bending strength MPa |
|---|---|---|---|---|---|
| This Invention | 0.25 | 99.7 | 486 | 620 | — |
| | 0.81 | 98.6 | 750 | 785 | 856 |
| | 1.30 | 96.3 | 885 | 787 | 880 |
| | 1.50 | 96.5 | 941 | — | 832 |
| | 2.00 | 96.8 | 1012 | — | 727 |
| | 4.00 | 96.3 | 1217 | — | 640 |
| Comparative Examples | 0.20 | 95.2 | 410 | 490 | — |
| | 5.00 | | non-sinterable | | |

As is clear from Table 4, by setting the weight mixing ratio of the Mo—Si—B-based alloy powder to the Mo powder to the range of 0.25 or more and 4.0 or less, the relative density of the sintered body was higher than that of the sintered body outside the range. In the range of 0.25 or more and 1.3 or less, the high-temperature 0.2% proof stress was higher than that of the sintered body outside the range. In the range of greater than 1.3 and 4.0 or less, the room-temperature hardness was higher than that of the sintered body outside the range and, since the bending amount in a bending test was so small that the 0.2% proof stress could not be measured, the strength was evaluated by a bending strength. As a result, it was seen that the strength was higher than that of the sintered body outside the range. With respect to the sintered body in which the weight mixing ratio of the Mo—Si—B-based alloy powder to the Mo powder was 0.2 or 0.25, since it was not fractured in a bending test so that the measurement limit of a tester was exceeded, the bending strength could not be measured.

From these result, it was seen that the relative density, high-temperature 0.2% proof stress, and bending strength of the sintered body using the Mo—Si—B-based alloy powder were increased by appropriately setting the weight mixing ratio.

<Evaluation of Pre-Reduction Treatment of Raw Material MoB Powder>

In the above-mentioned Examples, the MoB powder having an oxygen content of 7.82% was used in the manufacture of the Mo—Si—B-based alloy powder and it has been shown that, even with this oxygen content, the object of this invention can be sufficiently achieved by carrying out the pre-reduction treatment. However, the MoB powder adsorbs moisture in the air during its storage so that oxidation may proceed to increase the oxygen content to about 10 mass %. Accordingly, next, the effect of a heat treatment for pre-reduction of MoB will be described in detail. Specifically, a MoB powder with an oxygen content of 9.8% was subjected to a heat treatment at temperatures of 800° C. to 1450° C. for 1 hour and then subjected to a disintegration treatment for 15 minutes using a mortar and, thereafter, the oxygen contents were measured. The results are shown in Table 5.

TABLE 5

| | Heating Temperature ° C. | Oxygen Content % |
|---|---|---|
| This Invention | 900 | 5.3 |
| | 1150 | 2.5 |
| | 1300 | 1.2 |
| Comparative Examples | 800 | 9.5 |
| | 1450 | not applicable because of low recovery rate |

From Table 5, it was seen that the oxygen content decreasing effect was obtained by setting the heating temperature of the heat treatment for reducing MoB to 900° C. to 1300° C., that the oxygen content was hardly decreased at 800° C., and that, at 1450° C., the powder was baked to adhere to a boat, resulting in a recovery rate of about 60%, which was unsuitable for practical use.

From these results, it was seen that the heating temperature of the heat treatment for reducing MoB was preferably set to 900° C. or more and 1300° C. or less.

Example 2

In Example 1, the results of mixing together the Mo powder, the MoB powder, and the $MoSi_2$ powder and heating the mixed powder in the hydrogen atmosphere to thereby manufacture the Mo—Si—B-based alloy powder have been described in detail.

Next, the results of heating a mixed powder in an atmosphere of an inert gas such as argon or nitrogen to thereby manufacture a Mo—Si—B-based alloy powder will be described as Example 2.

Specifically, use was made of a Mo powder which was the same as that in Example 1, a MoB powder with an oxygen content of 730 ppm, and a $MoSi_2$ powder with an oxygen content of 2830 ppm and an atmosphere for heating was set to argon or nitrogen. Mo—Si—B-based alloy powders were manufactured in the same manner as described in Example 1 except for the above. However, since the oxygen content of the raw material MoB powder was sufficiently low, a pre-reduction step was not carried out.

Table 6 shows the results of evaluating the obtained Mo—Si—B-based alloy powders.

TABLE 6

| | | | | |
|---|---|---|---|---|
| Powder | $Mo_5SiB_2$(600) full width at half maximum deg. | 0.18 | 0.12 | 0.12 |
| | Si content mass % | 4.9 | 4.9 | 5.9 |
| | B content mass % | 4.1 | 4.0 | 4.2 |
| | BET $m^2/g$ | 0.18 | 0.15 | 0.15 |
| Powder Manufacturing Conditions | heating temperature ° C. | 1650 | 1650 | 1650 |
| | heating time min. | 60 | 60 | 60 |
| | atmospheric gas | argon | nitrogen | hydrogen |
| | disintegration time min. | 60 | 60 | 60 |
| Sintered Body | relative density % | 98.1 | 98.7 | 98.9 |
| | 0.2% proof stress at high temperature MPa | 762 | 795 | 813 |

As shown in Table 6, the full width at half maximum of (600) of $Mo_5SiB_2$, the Si content, the B content, and the particle size measured by the BET method were substantially equal to those of the powder, synthesized in the hydrogen atmosphere, shown in the above-mentioned Example and the properties of sintered bodies manufactured using the obtained Mo—Si—B-based alloy powders were also substantially the same as those of the powder of the above-mentioned Example. That is, from these results, it was seen that if a Mo—Si—B-based alloy powder was manufactured by using raw material powders with low oxygen contents as a MoB powder and a $MoSi_2$ powder and heating a mixed powder in an atmosphere of an inert gas such as argon or nitrogen, the Mo—Si—B-based alloy powder satisfying the required properties could also be manufactured other than in a hydrogen atmosphere.

INDUSTRIAL APPLICABILITY

While this invention has been described with reference to the embodiment and the Examples, this invention is not limited thereto.

It is apparent that those skilled in the art can think of various modifications and improvements in the scope of this invention and it is understood that those also belong to the scope of this invention.

This invention is applicable to a heat-resistant member particularly in a high-temperature environment, such as a friction stir welding tool, a glass melting jig tool, a high-temperature industrial furnace member, a hot extrusion die, a seamless tube manufacturing piercer plug, an injection molding hot runner nozzle, a casting insert mold, a resistance heating deposition container, an airplane jet engine, or a rocket engine.

Further, by granulating a Mo—Si—B-based alloy powder of this invention, it can also be applied as a powder for powder flame spraying or gas plasma spraying. This makes it possible to form a high heat-resistant coating film on surfaces of various metal materials, thereby imparting high heat resistance thereto.

The invention claimed is:

1. A Mo—Si—B-based alloy powder comprising:

$Mo_5SiB_2$, oxygen in a content of 200 mass ppm or more and 45000 mass ppm or less, carbon in a content of 50 mass ppm or more and 1000 mass ppm or less, an inevitable compound, and an inevitable impurity, wherein a full width at half maximum of a (600) peak of the $Mo_5SiB_2$ in X-ray diffraction is 0.08 degrees or more and 0.7 degrees or less, and wherein the $Mo_5SiB_2$ is a main component.

2. The Mo—Si—B-based alloy powder according to claim 1, wherein the Si content is 4.2 mass % or more and 5.9 mass % or less, the B content is 3.5 mass % or more and 4.5 mass % or less, and the balance is Mo and an inevitable impurity.

3. The Mo—Si—B-based alloy powder according to claim 1, wherein a specific surface area measured by a BET method is 0.05 $m^2/g$ or more and 1.0 $m^2/g$ or less.

4. The Mo—Si—B-based alloy powder according to claim 1, wherein a (204) peak intensity of the $Mo_5SiB_2$ is higher than a (114) peak intensity of the $Mo_5SiB_2$ in the X-ray diffraction.

5. The Mo—Si—B-based alloy powder according to claim 1, wherein the oxygen content is 840 mass ppm or more and 21600 mass ppm or less and the carbon content is 80 mass ppm or more and 220 mass ppm or less.

6. A metal-material raw material powder being a mixed powder comprising the Mo—Si—B-based alloy powder according to claim 1 and a powder of at least one or more kinds selected from the group consisting of Group IVA, VA, and VIA elements.

7. The metal-material raw material powder according to claim 6, wherein the powder selected from the group consisting of the Group IVA, VA, and VIA elements is a powder of at least one or more kinds of Mo, W, Ta, Nb, and Hf.

8. A Mo—Si—B-based alloy powder comprising:

$Mo_5SiB_2$, wherein a full width at half maximum of a (600) peak of the $Mo_5SiB_2$ in X-ray diffraction is 0.08 degrees or more and 0.7 degrees or less, and wherein the $Mo_5SiB_2$ is a main component.

9. A method of manufacturing the Mo—Si—B-based alloy powder according to claim 1, comprising:

a mixing step of using a Mo powder, a $MoSi_2$ powder, and a MoB powder as raw materials and mixing them in a predetermined mixing ratio;

a heat treatment step of heat-treating a mixed powder, obtained by the mixing step, at 1350° C. or more and 1750° C. or less in an atmosphere containing hydrogen or an inert gas;

a disintegration treatment step of disintegrating a powder obtained by the heat treatment step; and a step of sieving a powder obtained by the disintegration treatment step.

10. The Mo—Si—B-based alloy powder manufacturing method according to claim 9, comprising a pre-reduction step of, prior to the mixing step, heat-treating in advance the MoB powder at 900° C. or more and 1300° C. or less in a hydrogen atmosphere.

* * * * *